US005664712A

United States Patent [19]

Smrt

[11] Patent Number: 5,664,712

[45] Date of Patent: Sep. 9, 1997

[54] DEVICE AND METHOD FOR TRANSPORTING A CONTAINER OR HAND TOOL

[76] Inventor: Thomas J. Smrt, 9716 S. Grant Hwy., Marengo, Ill. 60152

[21] Appl. No.: 453,478

[22] Filed: May 30, 1995

[51] Int. Cl.[6] ..... A45F 3/14

[52] U.S. Cl. ..... 224/250; 224/269; 224/251; 224/904

[58] Field of Search ..... 224/250, 251, 224/252, 254, 255, 220, 226, 269, 198, 215, 904, 191, 197, 651, 676, 677; 103/229

[56] References Cited

U.S. PATENT DOCUMENTS

| | | | |
|---|---|---|---|
| 4,386,724 | 6/1983 | Kotler | 224/255 |
| 4,762,257 | 8/1988 | Spillers et al. | 224/250 |
| 4,865,239 | 9/1989 | Timbrook | 224/220 |
| 5,060,835 | 10/1991 | Payne | 224/250 |
| 5,082,156 | 1/1992 | Braun | 224/220 |
| 5,217,294 | 6/1993 | Liston | 224/250 |

*Primary Examiner*—David J. Walczak

*Attorney, Agent, or Firm*—Leydig, Voit & Mayer, Ltd.

[57] ABSTRACT

Device and related method for transporting containers, such as aerosol paint cans, or hand tools, wherein the device, when holding such a container or tool, is able to be fastened onto an article of clothing, allowing the container to be carried without the use of one's hands.

22 Claims, 6 Drawing Sheets

DEVICE AND METHOD FOR TRANSPORTING A CONTAINER OR HAND TOOL

TECHNICAL FIELD OF THE INVENTION

The present invention relates to devices and methods which enable a person to transport containers and small tools, more particularly, full and empty cylindrical aerosol paint containers as well as small hand tools.

BACKGROUND OF THE INVENTION

When painting or otherwise applying marking compositions from an aerosol container onto pavement, ground, or other substrate, the contents of several such containers may be required to complete the task. This would require one to carry a number of aerosol containers both to (e.g., full containers) and from (e.g., empty and unused or partially used containers) the job site. This may require several trips to and from the site. Moreover, one may be faced with the problem of transporting the aerosol containers about the site if, for example, one is marking pavement or ground to indicate the location of utility lines. This scenario would require full containers to be transported about the site to ensure that sufficient marking composition is available to complete the job, while further requiring the transportation of any empty containers about the job site so they can be properly disposed of after marking is completed. This transportation of multiple aerosol containers can become inconvenient and, in some cases, impossible if other items are also required to be simultaneously carried about the job site, e.g., papers, calculators, and/or surveying equipment.

Moreover, when working on a job site, it is often necessary to use a number of tools. Transporting the various odd-shaped tools, e.g., hammers, screwdrivers, trowels, brushes, flashlights, and the like, to and from the job site often requires several round trips.

Thus, there exists a need for a device and related method which would allow one to hold and transport one or more containers, such as aerosol paint containers, and/or a variety of tools, without requiring the use of one's hands to accomplish same.

BRIEF SUMMARY OF THE INVENTION

The present invention meets the aforesaid need by providing a means for transporting one or more containers, for example, aerosol containers, and/or small tools, without requiring the use of one's hands.

One aspect of the present invention allows one to transport, or carry, a container on an article of clothing. This method comprises providing a carrying device which comprises a flexible, continuous, stretchable elastic strap and a fastening device attached to the strap. The elastic strap is sized so that, when it is formed into a circle in a non-stretched condition, it has a diameter that is less than the diameter of the outer surface of the container that one desires to carry. Once provided with this device, one encircles the outer surface of the container with the elastic strap so that the container is held within the elastic strap. Thereafter, or alternatively prior to encircling the container with the strap, the carrying device is attached to a desired article of clothing by use of the fastening device. In a preferred embodiment, the method of the present invention allows one to carry one or more aerosol containers.

In another aspect of the present invention, one is allowed to transport a small tool, e.g., a screwdriver, hammer, trowel, brush, or the like, on an article of clothing. In this aspect, the method is the same as that described in the foregoing paragraph, with the exception that the elastic strap is sized so that, when it is formed into a circle in a non-stretched condition, it has a diameter that is less than the distance about the outer surface of the tool one desires to carry. Of course, the outer surface referred to is the surface that will be in contact with the elastic strap after the strap is fitted onto the tool.

Another aspect of the present invention comprises a system which allows one to transport at least one container or tool, again, without the use of one's hands to do so. The system comprises the combination of the carrying device as previously described with a container or tool encircled by and held within the strap of the carrying device.

A further aspect of the present invention comprises the carrying device itself.

The invention may best be understood with reference to the accompanying drawings wherein illustrative embodiments are shown and in the detailed description of the preferred embodiments which follows thereafter.

DESCRIPTION OF THE PREFERRED EMBODIMENTS

One aspect of the present invention provides a device for transporting a cylindrical container, e.g., an aerosol paint can, or small tool, e.g., screwdriver, hammer, trowel, brush, flashlight, or the like, without using one's hands.

Figure 1:
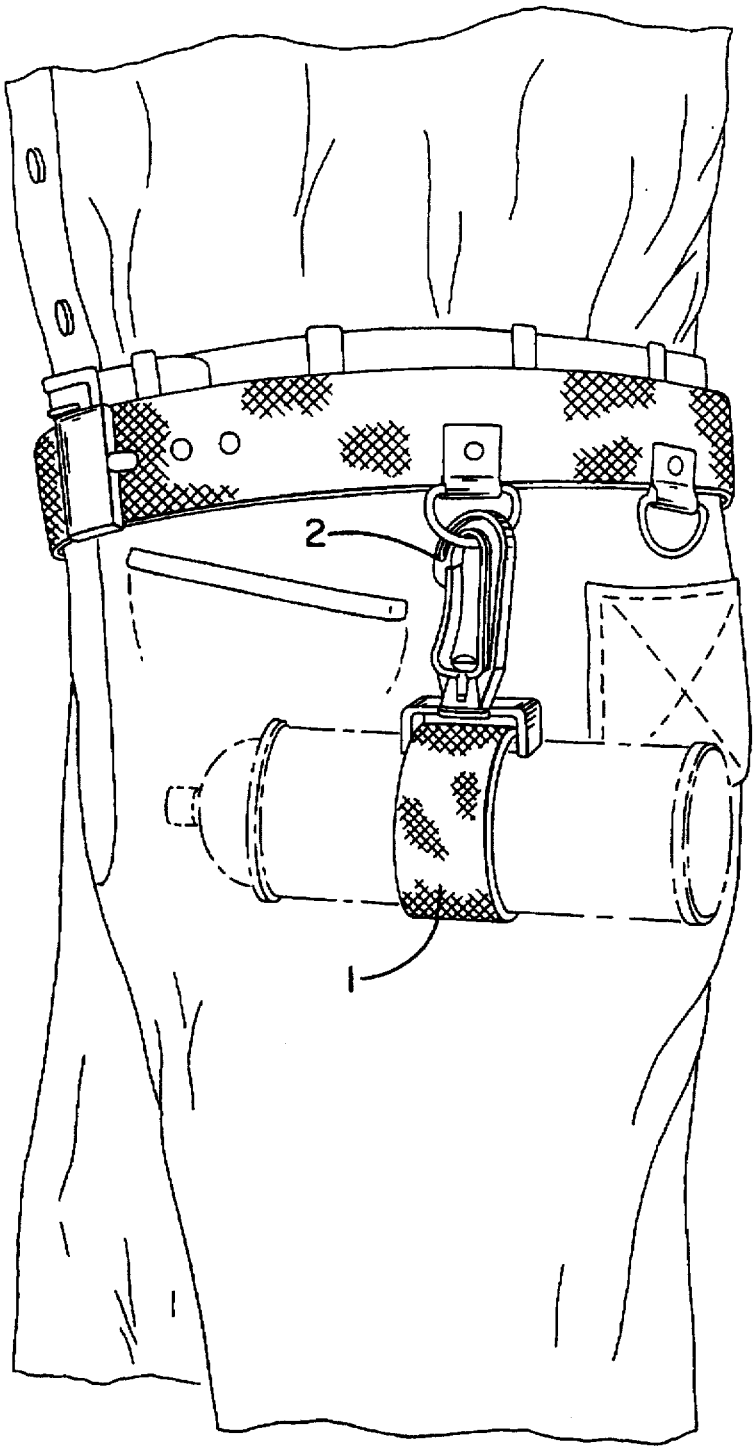
FIG. 1 is an illustration of one embodiment of the carrying device of the present invention wherein the device is shown as being attached to an article of clothing, specifically, a belt. A cylindrical aerosol container (in phantom) is shown being held by the device.

Referring initially to FIG. 1, there is illustrated a preferred embodiment of the carrying device of the present invention. This carrying device is shown holding a cylindrical aerosol container (illustrated in phantom) and is further attached to a utility belt, demonstrating the ability of the present invention to provide for the transport of a container, such as a cylindrical aerosol paint can, by a person without the use of that person's hands.

Figure 2:
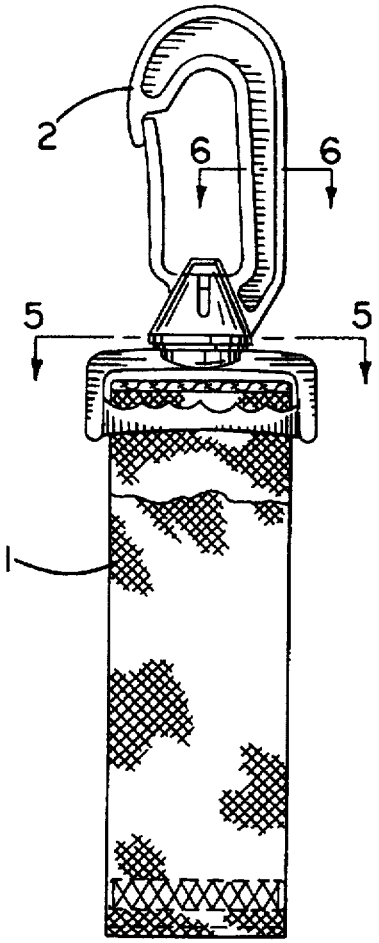
FIG. 2 is a front view of the embodiment of the carrying device of the present invention illustrated in FIG. 1.

The device shown in FIG. 1 comprises a flexible, continuous, stretchable elastic strap 1 and a fastening device 2 attached to the strap. The strap 1 is designed to be stretched and slipped onto the outer surface of a container or tool so that it encircles the container or tool. The strap, stretched in this manner about a cylindrical aerosol container, is illustrated in FIG. 1. FIG. 2 illustrates the device itself, without a container or tool being held thereby. The strap 1, once in position on the container or tool, remains in a stretched condition. This assists in creating the necessary friction between the strap and the outer surface of the container or tool which in turn causes the container or tool to be retained (held) within the strap during use.

The strap 1 is advantageously dimensioned so it can be easily stretched and slipped over the outer surface of the container or tool by a user, while also providing sufficient tension to retain the container or tool within the strap—to prevent the container or tool from slipping out of the strap when in use. More particularly, the elastic strap 1 should be dimensioned so that, when it is formed into a circle in a non-stretched condition, it has a diameter that is less than the distance about the outer surface of the container or tool that is desired to be carried. Of course, the outer surface referred to is the surface that will be in contact with the elastic strap after the strap is fitted onto the container or tool to be carried. For example, in the case of a cylindrical aerosol container, the strap, when formed into a circle in a non-stretched condition, has a diameter that is less than the diameter of the outer cylindrical surface of the cylindrical container. This sizing of the strap ensures that the strap remains in a stretched condition while the container or tool resides therein.

Figure 8:
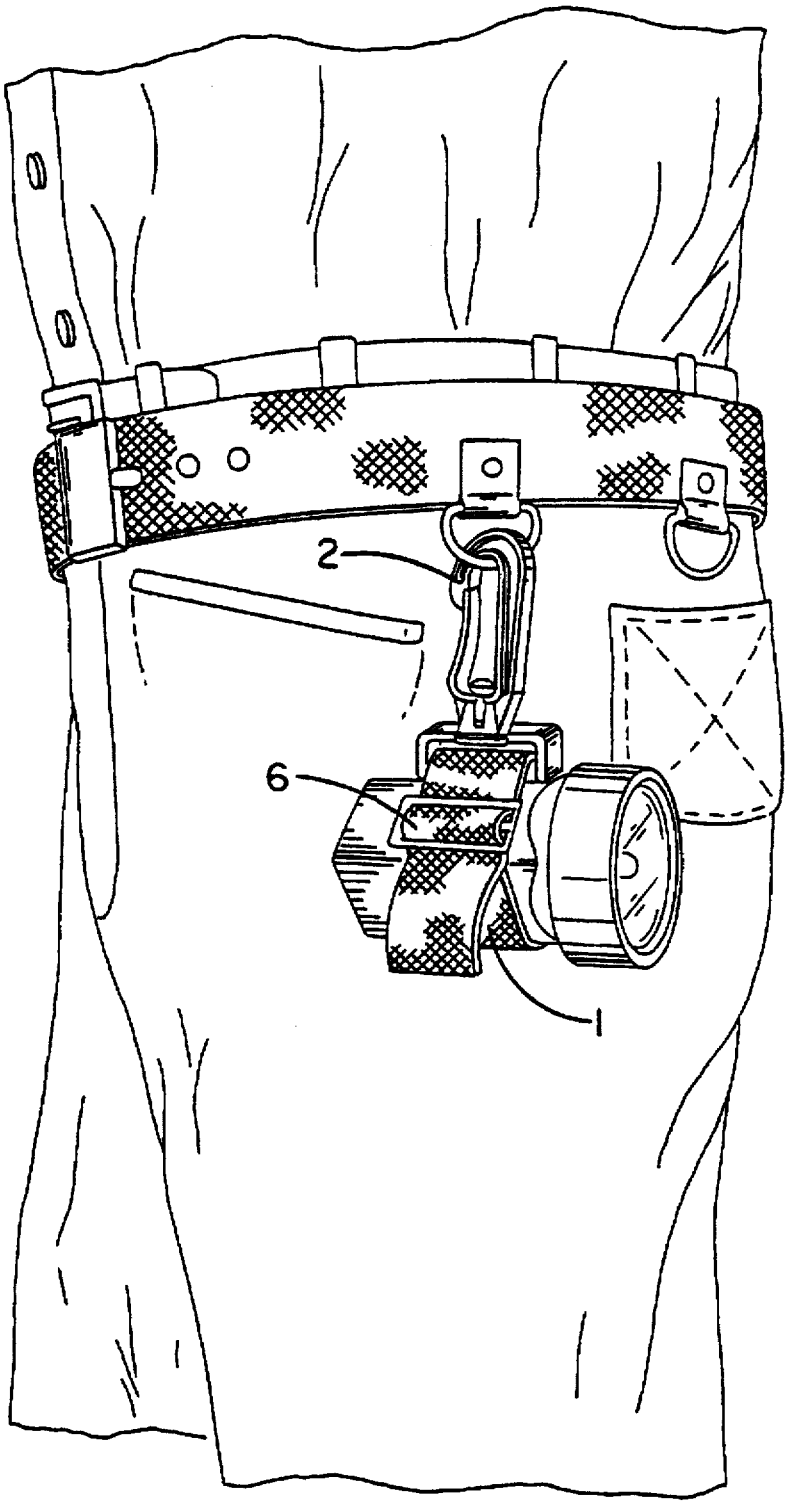
FIG. 8 is an illustration of the embodiment set forth in FIG. 7, wherein a hand tool, in this case a flashlight having a generally square cross-section (in phantom), is shown being held by the device.
Figure 9:
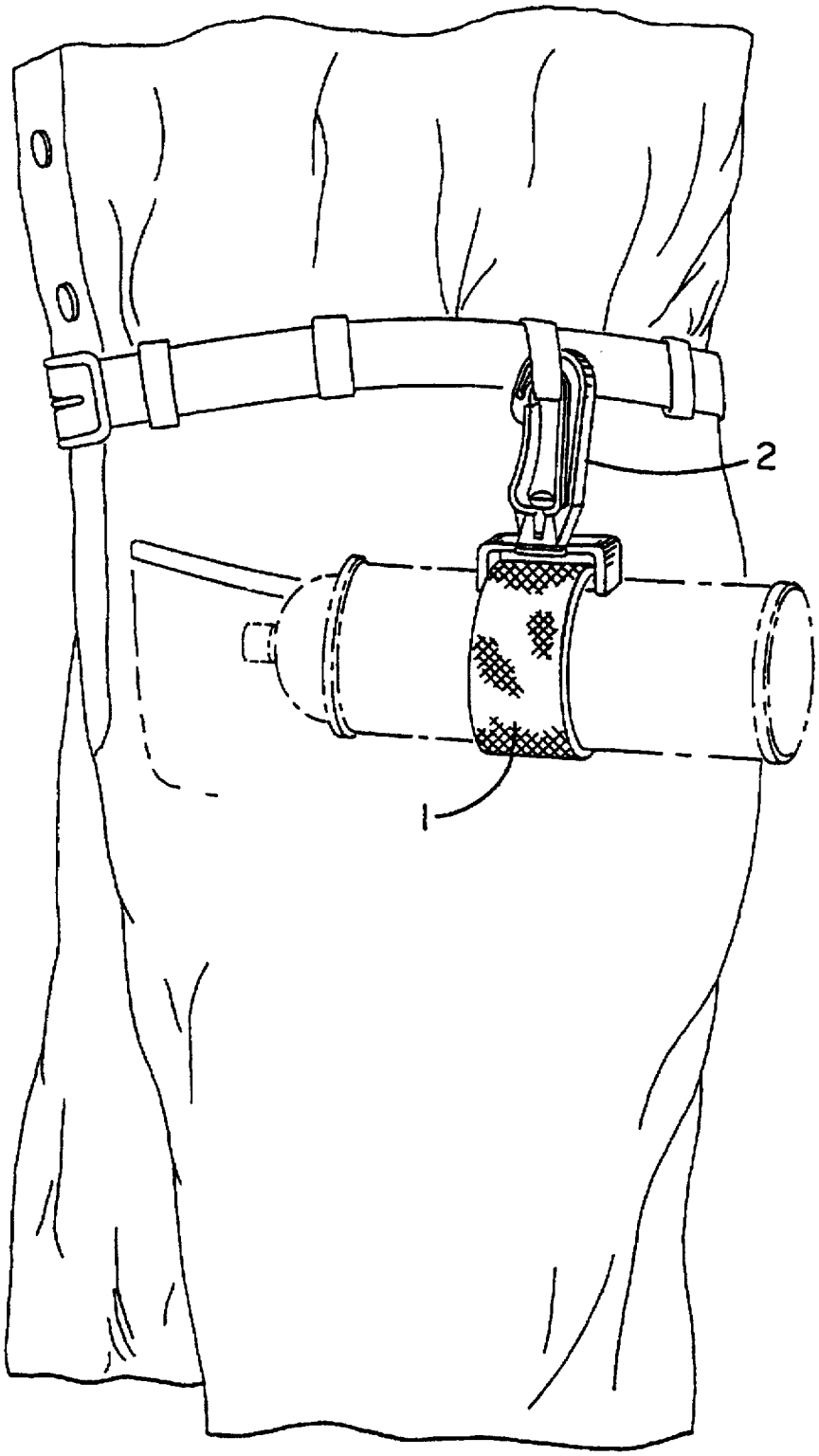
FIG. 9 is an illustration of the embodiment of the carrying device of the present invention illustrated in FIG. 1, wherein the device is shown attached to a perforation in an article of clothing, specifically, a belt loop.
Figure 10:
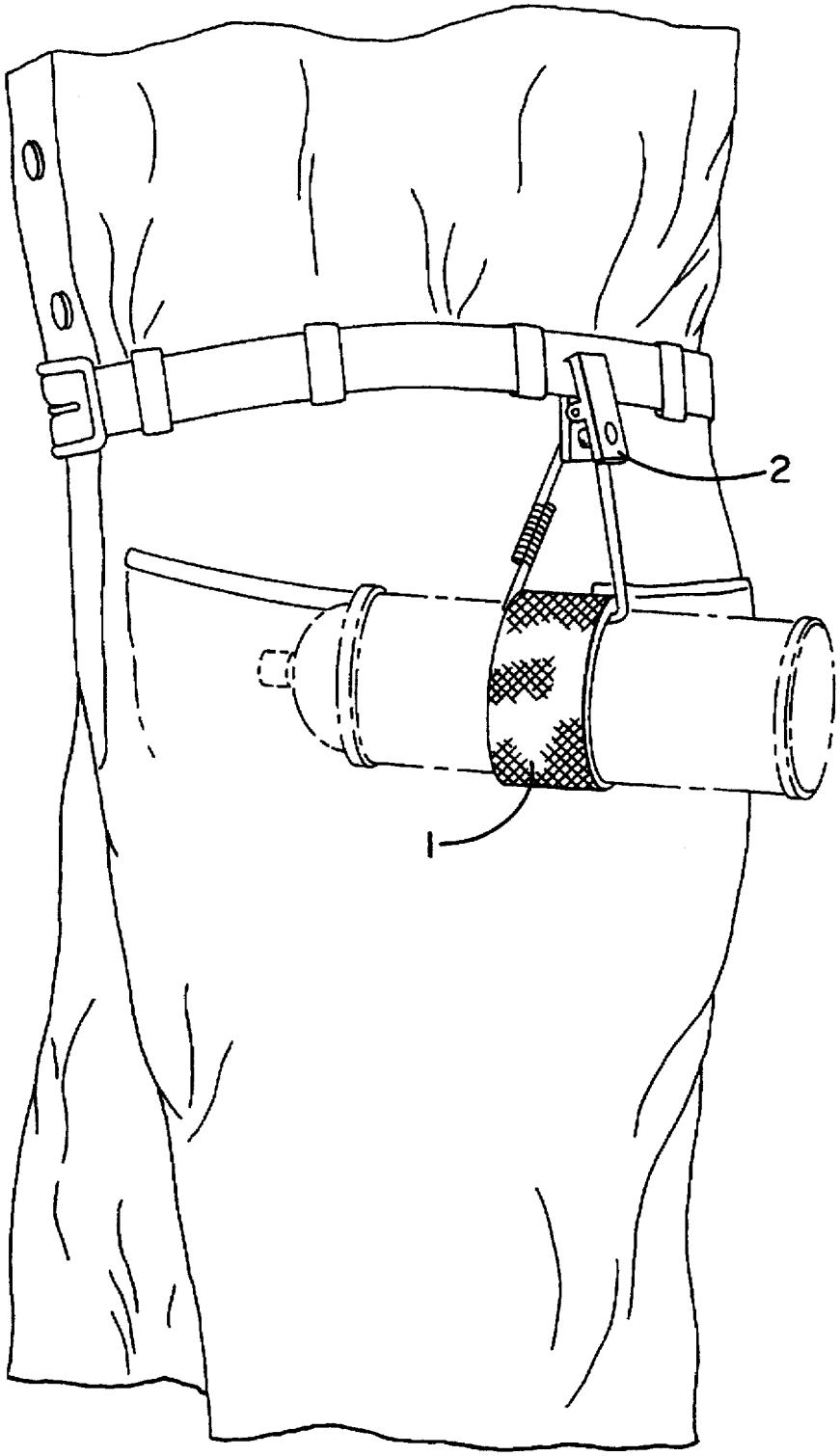
FIG. 10 is an illustration of another embodiment of the carrying device of the present invention, wherein the fastening device comprises an alligator clip.

Thus, as will be apparent from the foregoing description, the carrying device of the present invention may also be used to hold a hand tool which has other than a cylindrical cross-section, e.g., a substantially triangular, square, rectangular, pentagonal, hexagonal, etc., cross-section. By way of example, the device of the present invention holding a flashlight (in phantom) which has a generally square cross-section is illustrated in FIG. 8.

With regard to the strap width, such may preferably range between about ½ to about 1½ inches. This has been found to provide a sufficient area of contact between the container or tool and the strap so that the container or tool is retained within the strap during use, while not impeding a user's ability to relatively easily slip the strap onto the outer surface of the container or tool.

The elastic strap of the device may comprise any flexible, stretchable material; advantageously it will comprise a woven fabric comprising elastic yarn. Rubber or other similar types of stretchable non-woven natural and synthetic materials may also be successfully used in the device. Preferably, the material will also be selected to optimize the friction between the container or tool and the material, while at the same time not unduly hindering one's ability to slip the strap onto the container or tool. The preferred material is a fabric comprising polyester and rubber which is about 1 inch in width (N48027, CMI Industries, Inc., Stuart, Va.).

When preparing the continuous elastic strap for use in the device, the strap is prepared from a strip of elastic material, wherein the two ends of the strip are attached to one another to provide a continuous Strap. Any means of attaching the ends may be used, e.g., by sewing the ends together with thread, or by use of a permanent or reusable clip. If use of a clip is desired, any clip which provides the requisite attachment of one end of the strap to the other is acceptable, e.g., metal clips having teeth which secure the clip to each end of the material when the clip is crimped.

The use of clips which are reusable allow the diameter of the resulting strap to be varied over a number of uses, depending upon the specific diameter of the outer surface of the particular container or tool desired to be carried.

The aforementioned permanent and reusable clips are well known to those skilled in the art, and will not be further described herein.

Figure 7:
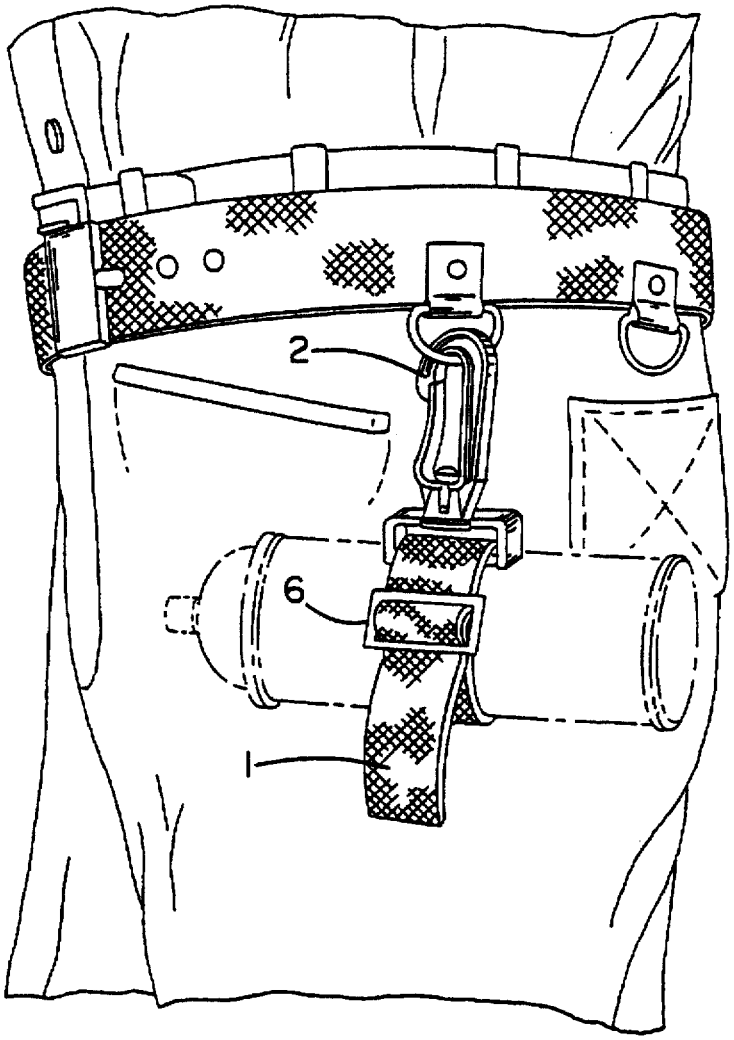
FIG. 7 is an illustration of another embodiment of the carrying device of the present invention wherein the device is attached to an article of clothing, specifically, a belt. A cylindrical aerosol container (in phantom) is shown being held by the device.

Alternatively, the straps may be joined by use of a buckle which also provides for variability in the diameter of the resulting strap over several uses. One such buckle is illustrated in FIG. 7. As shown therein, this particular buckle 6 allows a first end of strap material to be threaded therethrough in a manner so that, after the material has been threaded through, the material that remains in contact with the buckle is prevented from moving relative to the buckle. The second end of the strap material (not shown) is attached to the buckle 6 so that, when the first end of the material is in the desired position within the buckle, a continuous strap is provided. It will be appreciated that, when such a buckle is used, a user may adjust the diameter of the strap either prior to or after inserting a container or tool into the device.

Figure 3:
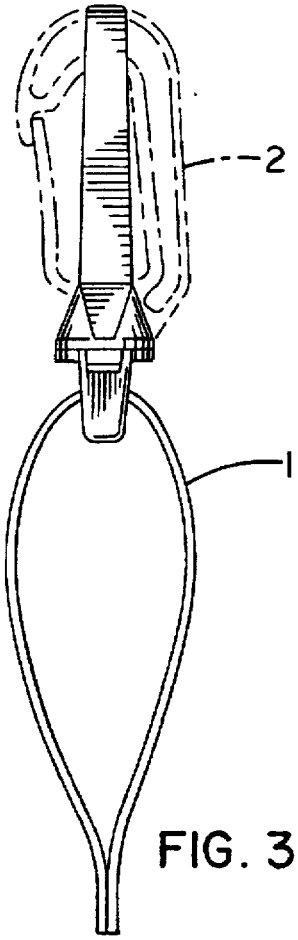
FIG. 3 is a side view of the carrying device illustrated in FIG. 2 wherein one embodiment of the fastening device, a hook, is shown in two possible positions, demonstrating the ability of this particular hook to swivel about its longitudinal axis.
Figure 4:
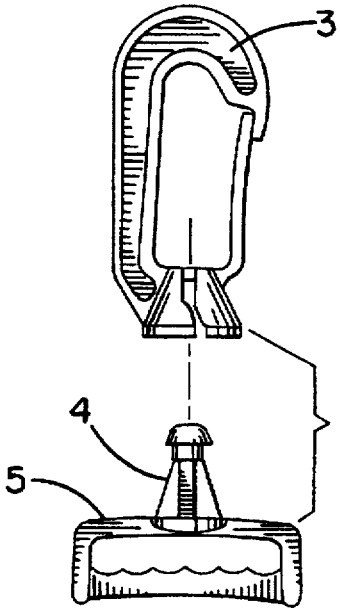
FIG. 4 is a rear view of the upper portion of the carrying device illustrated in FIG. 2, wherein it is shown that the particular fastening device used in that embodiment of the device is comprised of three parts.
Figure 5:
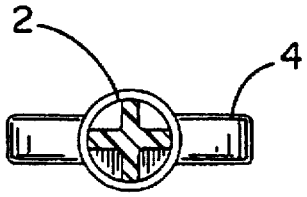
FIG. 5 is a cross-sectional view of the fastening device illustrated in FIG. 2.
Figure 6:
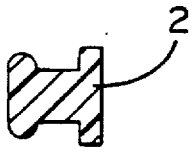
FIG. 6 is another cross-sectional view of the fastening device illustrated in FIG. 2.

The illustrative devices shown in the figures includes one particular preferred embodiment of a fastening device, a hook. (Style 303, 1 inch, American Cord & Webbing). Although any type of fastening device which will allow the elastic strap to be attached to a user's clothing may be used, e.g., an "alligator"-type clip, one particular fastening device, a hook, provides the advantage of easy attachment and detachment from the user's clothing, particularly a belt loop on a pair of pants. The particular hook set forth in the figures provides the further advantage of allowing the upper portion of the hook to rotate about its longitudinal axis with respect to the hook base 5 and the strap 1. This rotation is illustrated in FIG. 3, wherein the upper portion of the hook is shown in a first position, as well as in a second position (in phantom, after rotating 90° about its longitudinal axis). This allows a user to quickly and easily orient the container or tool into its proper position when attaching the device and container or tool combination onto an article of clothing.

This preferred hook comprises three parts. The upper hook portion 3 is that portion of the hook which attaches to the user's clothing. The second portion comprises a post 4. This post provides a means of attachment for the upper hook portion to the third part, the hook base 5, and further provides a surface about which the upper hook portion 3 may rotate. The post 4 and hook base 5 are attached in a fixed relation to one another, e.g., by glue. The hook base 5 defines an opening through which the strap 1 is threaded prior to forming the continuous elastic strap by any of the means described herein.

The carrying device of the present invention may be attached to an article of clothing of the user either prior to or after the aerosol container is slipped into the device. Moreover, although FIGS. 1 and 7 illustrate a preferred hook attached to a belt, the fastening device may be attached to any piece of clothing worn by a user, e.g., a pair of trousers, a belt, a skirt, a pair of shorts, or a shirt. When a hook is used as the fastening device, the clothing should provide a loop or perforation into which the hook can be inserted.

As should be appreciated in view of the foregoing description, the present invention provides a unique device and related method for transporting one or more containers, such as cylindrical containers, e.g., aerosol paint cans, as well as tools, hammers, screwdrivers, trowels, spades, brushes, awls, planes, chisels, shears, scrapers, flashlights, and the like, without requiring the use of one's hands to carry the containers directly (by holding them in one's hands) or indirectly (e.g., by pulling a cart with the containers or tools residing therein).

All of the references cited herein, including patents, patent applications, and publications, are hereby incorporated in their entireties by reference.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and scope of the invention as defined by the following claims.

What is claimed is:

1. A method for transporting a container having an outer surface on an article of clothing worn by a user comprising providing a carrying device comprising a flexible, continuous, stretchable elastic strap and a fastening device comprising a hook or an alligator clip attached to the strap, wherein the elastic strap when formed into a circle in a non-stretched condition has a diameter that is less than the distance about the outer surface of the container about which the elastic strap is located when the carrying device is in use, encircling the outer surface of the container with the elastic strap wherein the container remains within the elastic strap, and attaching the carrying device onto the article of clothing by use of the fastening device.

2. The method of claim 1, wherein the container is a cylindrical container, and wherein the elastic strap when formed into a circle in a non-stretched condition has a diameter that is less than the diameter of the outer surface of the cylindrical container.

3. The method of claim 1, wherein the article of clothing has at least one perforation therethrough, and wherein the fastening device comprises a hook, the hook being attached to the clothing by inserting the hook into the at least one perforation.

4. The method of claim 3, wherein the article of clothing is a belt.

5. The method of claim 1, wherein the article of clothing has at least one loop, and wherein the fastening device comprises a hook, the hook being attached to the clothing by inserting the hook into the at least one loop.

6. The method of claim 5, wherein the article of clothing comprises clothing selected from the group consisting of trousers, a belt, a skirt, shorts, and a shirt.

7. The method of claim 1, wherein the continuous strap comprises a strip of elastic material having two ends, the ends being attached to one another to form a continuous strap.

8. The method of claim 7, wherein the ends are attached to one another by thread.

9. The method of claim 1, wherein the continuous strap comprises a buckle through which material can be threaded which, when material has been threaded through and remains therein, prevents movement of the material remaining therein with respect to the buckle, and a strip of elastic material having two ends, the first end of the material being attached to the buckle and a portion of the second end being threaded through and remaining in the buckle so that a continuous strap is provided.

10. A method for transporting a hand tool having an outer surface on an article of clothing worn by a user comprising providing a carrying device comprising a flexible, continuous, stretchable elastic strap and a fastening device comprising a hook or an alligator clip attached to the strap, wherein the elastic strap when formed into a circle in a non-stretched condition has a diameter that is less than the distance about the outer surface of the hand tool about which the elastic strap will be located when the carrying device is in use, encircling the outer surface of the hand tool with the elastic strap wherein the container remains within the elastic strap, and attaching the carrying device onto the article of clothing by use of the fastening device.

11. The method of claim 10, wherein the continuous strap comprises a strip of elastic material having two ends, the ends being attached to one another to form a continuous strap.

12. The method of claim 10, wherein the continuous strap comprises a buckle through which material can be threaded which, when material has been threaded through and remains therein, prevents movement of the material remaining therein with respect to the buckle, and a strip of elastic material having two ends, the first end of the material being attached to the buckle and a portion of the second end being threaded through and remaining in the buckle so that a continuous strap is provided.

13. The method of claim 10, wherein the hand tool is a hammer, screwdriver, trowel, brush, awl, plane, spade, chisel, shears, flashlight, or scraper.

14. A system which allows a container to be carried by a person comprising a container having an outer surface and a carrying device comprising a fastening device which includes a hook or an alligator clip and a flexible, continuous, stretchable elastic strap attached to the fastening device, wherein the strap resides in a stretched condition around the outer surface of the container and the container remains within the stretched elastic strap, wherein the elastic strap when formed into a circle in a non-stretched condition has a diameter that is less than the distance about the outer surface of the container about which the elastic strap is located when the carrying device is in use.

15. The system of claim 14, wherein the container is a cylindrical container, wherein the elastic strap when formed into a circle in a non-stretched condition has a diameter that is less than the diameter of the outer surface of the cylindrical container.

16. The system of claim 14, further comprising an article of clothing to which the fastening device is attached.

17. A system which allows a hand tool to be carried by a person comprising a hand tool having an outer surface and a carrying device comprising a fastening device which includes a hook or an alligator clip and a flexible, continuous, stretchable elastic strap attached to the fastening device, wherein the strap resides in a stretched condition around the outer surface of the hand tool and the container remains within the stretched elastic strap, wherein the elastic strap when formed into a circle in a non-stretched condition has a diameter that is less than the distance about the outer surface of the hand tool about which the elastic strap is located when the carrying device is in use.

18. The system of claim 17, further comprising an article of clothing to which the fastening device is attached.

19. The system of claim 17, wherein the hand tool is a hammer, screwdriver, trowel, brush, awl, plane, spade, chisel, shears, or scraper.

20. A device for transporting a container having an outer surface on an article of clothing worn by a user comprising a flexible, continuous, stretchable elastic strap and a fastening device comprising a hook or an alligator clip attached to the strap, wherein the elastic strap when formed into a circle in a non-stretched condition has a diameter that is less than the diameter of the outer surface of the container to be transported, wherein the elastic strap, when encircled about the outer surface of the container, is in a stretched condition and retains the container therewithin.

21. A method for transporting a container having an outer surface on an article of clothing worn by a user comprising providing a carrying device comprising a flexible, continuous, stretchable elastic strap and a fastening device attached to the strap, wherein the elastic strap when formed into a circle in a non-stretched condition has a diameter that is less than the distance about the outer surface of the container about which the elastic strap is located when the carrying device is in use, encircling the outer surface of the container with the elastic strap wherein the container remains within the elastic strap, and attaching the carrying device onto the article of clothing by use of the fastening device, wherein the continuous elastic strap comprises elastic material having two ends and a buckle through which the elastic material can be threaded which, when the elastic material has been threaded through and remains therein, prevents movement of the elastic material remaining therein with respect to the buckle, wherein the first end of the elastic material is attached to the buckle and a portion of the second is threaded through and remaining in the buckle so that a continuous, stretchable elastic strap is provided.

22. A device for transporting a container having an outer surface on an article of clothing worn by a user comprising a flexible, continuous, stretchable elastic strap and a fastening device attached to the strap, wherein the elastic strap when formed into a circle in a non-stretched condition has a diameter that is less than the diameter of the outer surface of the container to be transported, wherein the elastic strap, when encircled about the outer surface of the container, is in a stretched condition and retains the container therewithin, wherein the continuous elastic strap comprises elastic material having two ends and a buckle through which the elastic material can be threaded which, when the elastic material has been threaded through and remains therein, prevents movement of the elastic material remaining therein with respect to the buckle, wherein the first end of the elastic material is attached to the buckle and a portion of the second is threaded through and remaining in the buckle so that a continuous, stretchable elastic strap is provided.

* * * * *